US006672070B2

(12) United States Patent
Bland et al.

(10) Patent No.: US 6,672,070 B2
(45) Date of Patent: Jan. 6, 2004

(54) GAS TURBINE WITH A COMPRESSOR FOR AIR

(75) Inventors: Robert Bland, Oviedo, FL (US); Charles Ellis, Stuart, FL (US); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/172,016

(22) Filed: Jun. 17, 2002

(65) Prior Publication Data

US 2003/0010014 A1 Jan. 16, 2003

(30) Foreign Application Priority Data

Jun. 18, 2001 (EP) ..... 01114599

(51) Int. Cl.[7] ..... F23R 3/42; F23R 3/54

(52) U.S. Cl. ..... 60/772; 60/39.37; 60/751; 60/752

(58) Field of Search ..... 60/772, 39.37, 60/751, 752, 760

(56) References Cited

U.S. PATENT DOCUMENTS

| | | | | |
|---|---|---|---|---|
| 2,414,410 A | | 1/1947 | Griffith | |
| 2,479,573 A | | 8/1949 | Howard | |
| 2,541,170 A | * | 2/1951 | Mayers et al | 60/751 |
| 2,565,308 A | * | 8/1951 | Hottel et al. | 60/751 |
| 2,600,235 A | * | 6/1952 | Galliot | 60/39.37 |
| 2,608,821 A | * | 9/1952 | Hunsaker | 60/791 |
| 2,627,720 A | * | 2/1953 | Williams et al. | 60/752 |
| 2,631,658 A | * | 3/1953 | Abraham | 60/39.281 |
| 2,765,620 A | | 10/1956 | Egbert | |
| 3,302,397 A | * | 2/1967 | Davidovic | 60/728 |
| 3,353,351 A | | 11/1967 | Bill | |
| 3,652,181 A | | 3/1972 | Wilhelm | |
| 3,657,882 A | | 4/1972 | Hugoson | |
| 4,195,474 A | | 4/1980 | Bintz et al. | |
| 4,704,869 A | * | 11/1987 | Iizuka et al. | 60/751 |
| 4,719,748 A | | 1/1988 | Davis, Jr. et al. | |
| 5,134,855 A | * | 8/1992 | Belcher et al. | 60/751 |
| 6,282,886 B1 | * | 9/2001 | Sato et al. | 60/39.37 |

FOREIGN PATENT DOCUMENTS

| | | |
|---|---|---|
| FR | 1110063 | 10/1955 |
| FR | 2757210 | 12/1996 |

* cited by examiner

*Primary Examiner*—Ted Kim
(74) *Attorney, Agent, or Firm*—Harness, Dickey & Pierce, P.L.C.

(57) ABSTRACT

In gas turbines, compressed air is supplied via an air duct to combustion chambers and is heated there. Pressure losses in the air duct should be minimized in order to ensure good overall efficiency. This is achieved by the compressed air flowing with approximately constant velocity in the air duct from the compressor to the inlet into the combustion chamber. This is supported by the effective cross section of the air duct being almost constant over this distance.

37 Claims, 2 Drawing Sheets

GAS TURBINE WITH A COMPRESSOR FOR AIR

The present application hereby claims priority under 35 U.S.C. Section 119 on European Patent application number 01114599.2 filed Jun. 18, 2001, the entire contents of which are hereby incorporated by reference.

FIELD OF THE INVENTION

The invention generally relates to a gas turbine with a compressor for air. More particularly, it relates to one which is heated in a plurality of combustion chambers connected in parallel with respect to flow, before it flows via a transfer duct to a gas duct in a turbine. It additionally can relate to a method of operating a gas turbine.

BACKGROUND OF THE INVENTION

In gas turbines, induced air is usually compressed initially, and is then heated in combustion chambers in order to achieve an economic power density. The hot gas generated in this process then drives a turbine.

In order to achieve good overall efficiency, it is inter alia necessary to keep flow losses small during the guidance of the compressed air. At the same time, however, various components of the turbine installation have to be cooled with the compressed and as yet unheated air. Thus, for example, a transfer or connecting duct, through which hot gas from the combustion chambers flows to the turbine, must be protected from overheating in order to avoid damage.

An arrangement which has widespread application for this purpose is given in FIG. 1 in U.S. Pat. No. 4,719,748. In this arrangement, a long connecting duct between a combustion chamber and a turbine inlet is located directly in an air duct through which compressed air flows to a burner. In this arrangement, no diffuser is shown for air deflection and the flow velocity of the air has fallen greatly on reaching the connecting duct. In consequence, correct cooling is at best possible at relatively low temperatures of the hot gas because higher temperatures require a specific flow velocity both for the compressed air and for the hot gas and a specific air duct height and alignment. As far as can be seen, adequate cooling cannot be achieved with this solution for either the upper side or the lower side of the connecting duct because, on the one hand, the volume of the air duct is very large in this region and because, in addition, both the length of the duct section to be cooled and the distance to be traversed by the compressed air after emergence from a compressor are relatively long.

In addition, however, a complicated cooling device, in which one combustion chamber and a connecting duct leading from this to a turbine are covered by a second wall relative to the flow of the compressed air, is the subject matter of the cited U.S. Pat. No. 4,719,748 in FIGS. 2 to 7 and the associated description. A multiplicity of openings, through which the compressed air is specifically deflected onto the wall sections to be cooled, are provided in this second wall. Although good cooling can be achieved by the variations given for this solution with respect to the number, the size and the shape of these openings, a disadvantage of this arrangement is a not insubstantial, unavoidable pressure loss in the compressed air because the latter must be repeatedly decelerated and accelerated again.

SUMMARY OF THE INVENTION

An embodiment of the invention includes an object of creating an arrangement, for a gas turbine, in which an unavoidable pressure loss in the flow of the compressed air is further reduced.

This object may be achieved, for example, by the compressed air flowing with approximately constant velocity over the whole distance in an air duct from the outlet of the compressor to the inlet into the combustion chambers. In this arrangement, the transfer duct may be expediently shorter than the diameter dimension of one of the combustion chambers. This solution is surprisingly advantageous because not only the pressure drop in the air duct but, in addition, a pressure drop in the transfer duct also are lowered to a very small value. In this arrangement, a constant velocity of the air in the air duct may be achieved by the effective cross section of the air duct being almost constant over the whole distance from the outlet of the compressor to the inlet into the combustion chambers.

BRIEF DESCRIPTION OF THE DRAWINGS

An exemplary embodiment of the invention is explained in more detail using drawings, wherein.

DETAILED DESCRIPTION OF THE PREFERRED EMBODIMENTS

Figure 1:
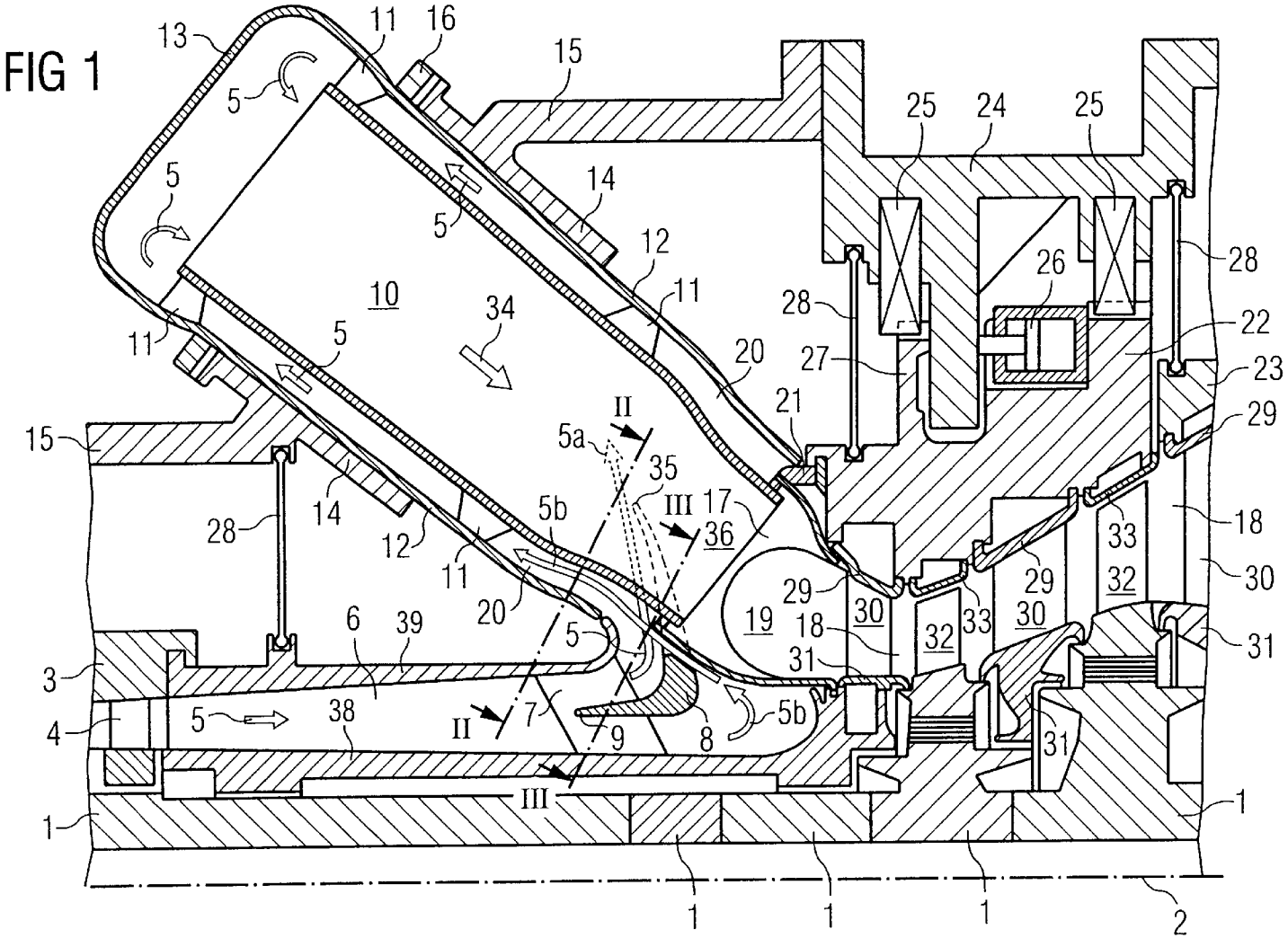
FIG. 1 shows an excerpt from a gas turbine in longitudinal section.
Figure 2:
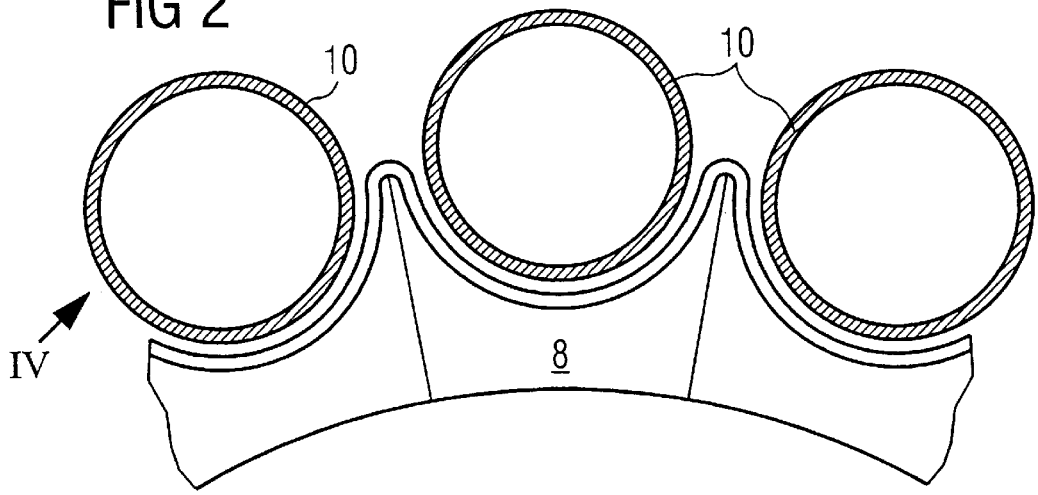
FIG. 2 shows a section along the line II—II in FIG. 1.

A rotor 1, shown as an excerpt, of a gas turbine installation rotates about a center line 2. In a compressor 3, compressed air leaves the compressor 3 through a ring of guide vanes 4 and flows, in the direction of the arrows 5, initially through a duct section 6, which is parallel to the center line and circular in cross section, of an air duct which is bounded on the inside by a wall 38 and on the outside by a wall 39.

At the end of this duct section 6, the compressed air passes struts 7. The struts 7 support a C-shaped cross section annular deflector 8 and are anchored in the end of the duct section 6 via struts 7. An arm 9, which is located in the end of the duct section 6, of the cross section of the deflector 8 forms, via its edge 9 facing upstream, a wavy line 37 oscillating about a circle concentric with the center line 1. The wall thickness of the deflector 8 increases strongly, starting from the edge 9 and extending to its center, and is not constant in the peripheral direction of the deflector 8 either, but increases and decreases in wave form.

Figure 3:
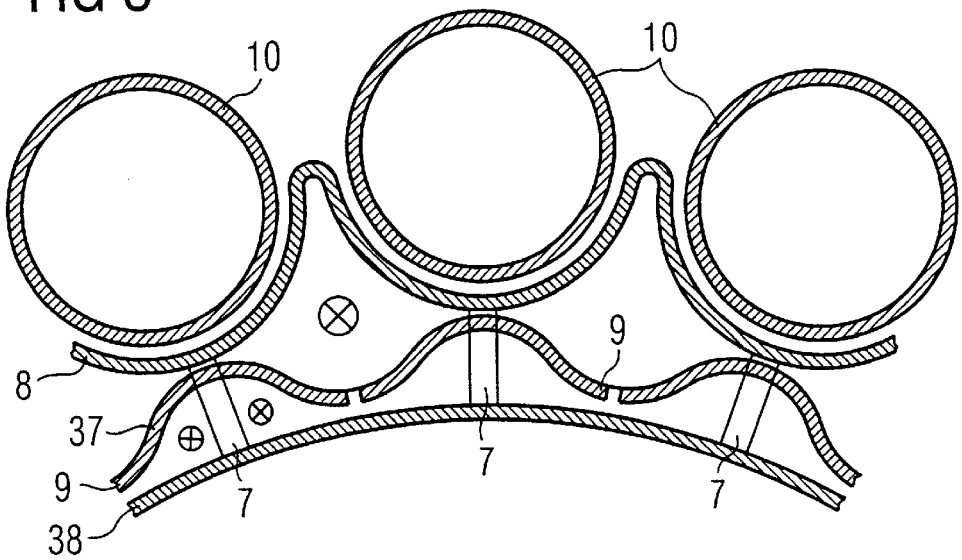
FIG. 3 shows a section along the line III—III in FIG. 1.

Combustion chambers 10 for heating the compressed air are arranged radially above the deflector 8. A cross-sectional arm, which is located radially on the outside, of the deflector 8 is essentially matched to the contour of the combustion chambers and forms, with its free end, a wave-shaped edge 35. This outer cross-sectional arm of the deflector 8 is, in addition, also wave-shaped per se, the waves formed in this way being opposite to the waves of the wavy line 37, as can be seen particularly well from FIG. 3.

The particular shape of the deflector 8, with its C-shaped cross section arms forming waves 35 and 37 in its peripheral direction, forces an airflow distribution in its region into a partial flow 5*a* to the upper surface of the combustion chambers 10 and into a partial flow 5*b* to the lower surface of the combustion chambers 10. In this arrangement, the upper surface of the combustion chambers 10 is located, relative to the gas turbine, radially on the outside and, correspondingly, the lower surface is located radially on the inside. The path distances of the partial flows 5*a* and 5*b* and are approximately equally large, so that all parts of the cooling air have to traverse equally long paths from the compressor 3 to the inlet into the combustion chambers 10.

Each of the combustion chambers 10 is supported, from the inside, via struts 11 on an outer casing 12, which is the outer wall of an air duct 20 and simultaneously represents a continuation of the air duct 6 for the air flowing in the direction of the arrows 5. The casing 12 supports, on its outer free end, a cap 13 through which the air is guided into the internal space of the combustion chamber 10.

Figure 4:
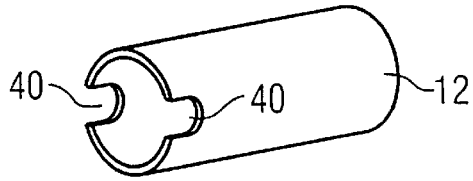
FIG. 4 shows a view in the direction IV of FIG. 2 onto an outer casing (not shown there) of a combustion chamber.

In the peripheral direction, the combustion chambers 10 are so tightly arranged adjacent to one another that the outer casings 12 have to mutually penetrate at their end facing toward the rotor 1. In order, nevertheless, to be able to push the combustion chambers 10, including their outer casings 12, as far as is desired in the direction toward the rotor 1, recesses 40 (FIG. 4) are provided on the outer casings 12, in the region of which recesses adjacent combustion chambers 10 have a common air duct 20 between them.

Fuel, for example a combustible gas or atomized, liquid fuel is, furthermore, supplied through a nozzle (not shown) to the internal space of the combustion chambers 10, the air in the combustion chamber 10 being heated to form a hot gas 34 by the combustion of this fuel.

The combustion chamber 10 and the outer casing 12 holding it are carried in a connecting piece 14 in a housing shell 15 and are fixed onto the outer end of the connecting piece 14 via a flange 16 firmly connected to the outer casing 12. An inner end 36 of the combustion chamber 10 is located, in a sealed manner, in a transfer duct 17, which connects the outlet of the combustion chamber 10 to a circular cross section gas duct 18 in a turbine. In order to admit hot gas 34 as evenly as possible to the gas duct 18 over its periphery, a multiplicity of, for example, ten to thirty combustion chambers 10 are evenly distributed over the periphery of the turbine installation and their openings into the transfer duct 17 are connected to one another by a peripheral duct 19 open in the direction of the gas duct 18. The transfer duct 17 is anchored to a guidance part 22 of the turbine by thin struts 21.

In order to transfer the compressed air flowing in the direction of the arrows 5 with as little loss as possible from the duct section 6 into the ducts 20 enveloping the combustion chambers 10, the deflector 8 supports a cross-sectional arm pointing in the direction of the free end of the combustion chambers 10. Its edge 35 follows, in wave shape and at a small distance, the contour of the transfer duct 17 and the contours of the ends 36 of the combustion chambers 10 opening into the latter. In this way, the airflow from the duct section 6 is deflected by more than 90° into a direction parallel to the center lines of the combustion chambers 10. By this, the combustion chambers 10 can be positioned with their center lines strongly inclined relative to the center line 1 without particular disadvantages, in which arrangement their compressor ends include an acute angle, so that they are located on a conical envelope concentric with the center line 2.

The guidance part 22 and a guidance part 23 are carried in a housing shell 24 and are secured against rotation by locking blocks 25. On the other hand, however, the guidance parts 22 and 23 can be displaced—by, for example, hydraulic or pneumatic motors 26—parallel to the center line over small distances, a flange 27 being elastically deformed and the deformation energy stored in it being used for restoring the guidance parts 22 and 23. A volume enclosed by the housing shells 15 and 24 is subdivided into chambers by partitions 28.

The guidance parts 22 and 23 have a funnel-type design and support guide vanes 30, which are fastened on their inside in guide rings 29, the ends of the guide vanes 30 opposite to the guide rings 29 being firmly connected together by rings 31. A ring of rotor blades 32, which are splined onto the rotor 1 and whose free tips are opposite to guide rings 33, is respectively provided between mutually adjacent rings of guide vanes 30. In this arrangement, the guide rings 29 and 33 form an outer boundary to the gas duct 18 in the turbine for the hot gas 34 and the rings 31, together with the roots of the rotor blades 32, form an inner boundary.

Parts of the turbine installation immediately exposed to the hot gas 34 are usually cooled, via ducts (not shown), by air tapped from the compressor or from the duct section 6. In particular applications, pockets immediately bordering the transfer duct 17 and located in a dead angle of the airflow near the deflector 8 are, where necessary, also cooled in this way. These pockets are then expediently separated from the air duct by partitions (not shown) so that their free and effective cross section can be more precisely matched, in the region of the transfer duct 17, to the cross section of the duct section 6 or the sum of the individual cross sections of the ducts 20. This cross section can, in addition, be adjusted precisely by variation of the wall thickness of the deflector 8 both in its peripheral direction and in its cross section.

Because the cross section of the duct section 6 and the sum of the individual cross sections of the ducts 20 are at least approximately equally large, a constant, equally large flow velocity is ensured for the compressed air in these duct sections. This flow velocity is maintained by the special shape of the C-shaped cross section deflector 8 even during the deflection of the compressed air by more than 90°. This avoids decelerations and renewed accelerations of the compressed air and, in consequence, losses caused by this are greatly reduced.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A gas turbine, comprising:

a plurality of combustion chambers, connected in parallel with respect to flow; and a compressor for air, wherein the air is heated in at least one of the combustion chambers before it flows to a gas duct in the gas turbine via a transfer duct, and wherein the compressed air flows with approximately constant velocity in an air duct, over a distance from an outlet of the compressor to an inlet into at least one of the combustion chambers.

2. The gas turbine as claimed in claim 1, wherein an effective cross section of the air duct is almost constant over the distance from the outlet of the compressor to the inlet into at least one of the combustion chambers.

3. The gas turbine as claimed in claim 2, wherein the air duct enforces a change in direction of more than 90° on air flowing in a region of the transfer duct and, wherein a deflector is provided in the air duct in this region only.

4. The gas turbine as claimed in claim 2, wherein the air duct opens into more than ten and up to thirty combustion chambers, evenly distributed over a periphery of the turbine.

5. The gas turbine as claimed in claim 2, wherein the partial air ducts of adjacent combustion chambers penetrate each other at their turbine end, while outer walls of the partial air ducts are provided with a corresponding recess in this region.

6. The gas turbine as claimed in claim 1, wherein the air duct enforces a change in direction of more than 90° on air flowing in a region of the transfer duct and, wherein a deflector is provided in the air duct in this region only.

7. The gas turbine as claimed in claim 6, wherein the deflector includes a C-shaped cross section ring.

8. The gas turbine as claimed in claim 7, wherein a wall thickness of the deflector is different both in cross section and in the peripheral direction and, by this, matches an effective cross section of the air duct in its region to the constant cross section of the air duct.

9. The gas turbine as claimed in claim 8, wherein a free end of one arm of the cross section of the deflector is located on a cylindrical envelope concentric with the turbine center line and wherein the free end of the other arm follows, in wave shape and at a small distance, contours of the combustion chambers.

10. The gas turbine as claimed in claim 9, wherein the arm of the C-shaped cross section following the contours of the combustion chambers with wave-shaped edge over its length respectively achieves a minimum under a combustion chamber center line and respectively achieves a maximum under an intermediate space between adjacent combustion chambers.

11. The gas turbine as claimed in claim 7, wherein cross-sectional arms of the C-shaped cross section deflector form wavy lines opposite to one another in the peripheral direction, the wave length of which waves corresponds to the distance of the combustion chambers from one another.

12. The gas turbine as claimed in claim 7, wherein a free end of one arm of the cross section of the deflector is located on a cylindrical envelope concentric with the turbine center line and wherein the free end of the other arm follows, in wave shape and at a small distance, contours of the combustion chambers.

13. The gas turbine as claimed in claim 7, wherein an arm of the C-shaped cross section of the deflector following the contours of the combustion chambers with wave-shaped edge over its length respectively achieves a minimum under a combustion chamber center line and respectively achieves a maximum under an intermediate space between adjacent combustion chambers.

14. The gas turbine as claimed in claim 6, wherein the air duct fans out, along the distance from the deflector to the opening into the combustion chambers, into a number of partial air ducts equal to the number of the combustion chambers, which partial air ducts together have approximately the constant cross section of the air duct.

15. The gas turbine as claimed in claim 6, wherein the deflector is supported by struts via its cross-sectional arm located upstream in the air duct, which struts are arranged approximately radially in the end of a circular cross section of the air duct.

16. The gas turbine as claimed in claim 15, wherein cross-sectional arms of a C-shaped cross section deflector form wavy lines opposite to one another in the peripheral direction, the wave length of which waves corresponds to the distance of the combustion chambers from one another.

17. The gas turbine as claimed in claim 6, wherein a wall thickness of the deflector is different both in cross section and in the peripheral direction and, by this, matches an effective cross section of the air duct in its region to the constant cross section of the air duct.

18. The gas turbine as claimed in claim 6, wherein a free end of one arm of the cross section of the deflector is located on a cylindrical envelope concentric with the turbine center line and wherein the free end of the other arm follows, in wave shape and at a small distance, contours of the combustion chambers.

19. The gas turbine as claimed in claim 6, wherein the air duct opens into more than ten and up to thirty combustion chambers, evenly distributed over a periphery of the turbine.

20. The gas turbine as claimed in claim 6, wherein the partial air ducts of adjacent combustion chambers penetrate each other at their turbine end, while outer walls of the partial air ducts are provided with a corresponding recess in this region.

21. The gas turbine as claimed in claim 6, wherein a deflector is provided in the air duct and wherein the deflector is supported by struts via its cross-sectional arm located upstream in the air duct, which struts are arranged approximately radially in the end of a circular cross section of the air duct.

22. The gas turbine as claimed in claim 1, wherein the air duct opens into more than ten and up to thirty combustion chambers, evenly distributed over a periphery of the turbine.

23. The gas turbine as claimed in claim 1, wherein an average length of a heated gas flow within the transfer duct from the outlet of the combustion chambers to the inlet into a gas duct in the turbine is approximately equal to twice the width of this gas duct at the inlet into the turbine, so that the length of this gas flow in the transfer duct is shorter than the diameter of one of the combustion chambers.

24. The gas turbine as claimed in claim 1, wherein center lines of the combustion chambers are located on a conical envelope and include an acute angle with the turbine center line.

25. The gas turbine as claimed in claim 1, wherein the partial air ducts of adjacent combustion chambers penetrate each other at their turbine end, while outer walls of the partial air ducts are provided with a corresponding recess in this region.

26. The gas turbine as claimed in claim 1, wherein the air duct fans out, along the distance from a deflector to the opening into the combustion chambers, into a number of partial air ducts equal to the number of the combustion chambers, which partial air ducts together have approximately the constant cross section of the air duct.

27. A gas turbine, comprising:

a plurality of combustion chambers, connected in parallel with respect to the airflow; and a compressor for air, wherein the compressed air flows with approximately constant velocity in an air duct, from an outlet of the compressor to an inlet into at least one of the combustion chambers, by which the compressed air is heated prior to entry.

28. The gas turbine as claimed in claim 27, wherein an effective cross section of the air duct is almost constant over the distance from the outlet of the compressor to the inlet into at least one of the combustion chambers.

29. The gas turbine as claimed in claim 27, wherein the air duct enforces a change in direction of more than 90° on air flowing in a region of the transfer duct and, wherein a deflector is provided in the air duct in this region.

30. The gas turbine as claimed in claim 29, wherein the deflector includes a C-shaped cross section ring.

31. The gas turbine as claimed in claim 30, wherein the arm of the C-shaped cross section following the contours of the combustion chambers with wave-shaped edge over its length respectively achieves a minimum under a combustion chamber center line and respectively achieves a maximum under an intermediate space between adjacent combustion chambers.

32. The gas turbine as claimed in claim 29, wherein a wall thickness of the deflector is different both in cross section and in the peripheral direction and, by this, matches an effective cross section of the air duct in its region to the constant cross section of the air duct.

33. The gas turbine as claimed in claim 29, wherein a free end of one arm of the cross section of the deflector is located on a cylindrical envelope concentric with the turbine center line and wherein the free end of the other arm follows, in wave shape and at a small distance, contours of the combustion chambers.

34. The gas turbine as claimed in claim 27, wherein the air duct opens into more than ten and up to thirty combustion chambers, evenly distributed over a periphery of the turbine.

35. A method of operating a gas turbine, comprising:

heating compressed air in at least one of a plurality of combustion chambers, connected in parallel with respect to flow; and compressing air in a compressor, wherein the compressed air flows with approximately constant velocity in an air duct, over a distance from an outlet of the compressor to an inlet into at least one of the combustion chambers.

36. The method of claim 35, wherein the compressed air flows in an air duct in which an effective cross section of the air duct is almost constant over the distance from the outlet of the compressor to the inlet into at least one of the combustion chambers.

37. The method of clam 35, further comprising:

enforcing, via the air duct, a change in direction of more than 90° on air flowing in a region of the transfer duct, wherein a deflector is provided in the air duct in this region only.

* * * * *